US007416536B2

(12) United States Patent
DeVlieger

(10) Patent No.: US 7,416,536 B2
(45) Date of Patent: Aug. 26, 2008

(54) CHEST VIBRATING DEVICE

(76) Inventor: Marten Jan DeVlieger, 5209-52nd Street, Taber, Alberta (CA) T1G 1M4

( * ) Notice: Subject to any disclaimer, the term of this patent is extended or adjusted under 35 U.S.C. 154(b) by 81 days.

(21) Appl. No.: 11/257,387

(22) Filed: Oct. 24, 2005

(65) Prior Publication Data

US 2006/0089575 A1 Apr. 27, 2006

Related U.S. Application Data

(63) Continuation-in-part of application No. 10/065,307, filed on Oct. 2, 2002, now Pat. No. 6,958,047.

(51) Int. Cl.
*A61H 1/00* (2006.01)
*A61H 11/00* (2006.01)

(52) U.S. Cl. ..... 601/71; 601/70; 601/79

(58) Field of Classification Search ..... 601/41–44, 601/46–49, 67, 69–71, 78–81
See application file for complete search history.

(56) References Cited

U.S. PATENT DOCUMENTS

| | | | |
|---|---|---|---|
| 3,053,250 | A | 9/1962 | Stubbs |
| 3,310,050 | A | 3/1967 | Goldfarb |
| 4,079,733 | A | 3/1978 | Denton et al. |
| 4,098,266 | A | 7/1978 | Muchisky et al. |
| 4,102,334 | A | 7/1978 | Muchisky |
| 4,216,766 | A | 8/1980 | Duykers et al. |
| 4,508,107 | A | 4/1985 | Strom et al. |
| 5,018,517 | A | 5/1991 | Lairdet |
| 5,056,505 | A | 10/1991 | Warwick et al. |
| 5,167,226 | A | 12/1992 | Larouche et al. |
| 5,235,967 | A | 8/1993 | Arbisi et al. |
| 5,261,394 | A | 11/1993 | Mulligan et al. |
| 5,451,190 | A | 9/1995 | Lairdet |
| 5,716,131 | A | 2/1998 | Breeding |

(Continued)

FOREIGN PATENT DOCUMENTS

| | | |
|---|---|---|
| GB | 1138898 | 12/1968 |

(Continued)

OTHER PUBLICATIONS

Rubin, Bruce K., "Emerging Therapies for Cystic Fibrosis" (1999) Chest 115:1120-1126.

(Continued)

*Primary Examiner*—Justine R Yu
*Assistant Examiner*—Kristen C Matter
(74) *Attorney, Agent, or Firm*—Bennett Jones LLP

(57) ABSTRACT

A chest vibrating device for assisting in loosening of obstructions in the lungs or air way of a human user suffering from respiratory ailments such as cystic fibrosis, which has a rigid frame which is positioned around, and clamped onto the user's chest, the rigid frame transferring to the user vibrations generated by a motor rotating an off-set weight, where the vibrations assist in loosening obstructions in the lungs or air way of the user. Pads adjustable in orientation and position radiate inwardly from the rigid frame to contact the user's chest from opposite sides of the chest and hold the chest in place, the pads adjusting to comfortably contact and effectively transmit vibrations to users of varying gender and size.

13 Claims, 12 Drawing Sheets

U.S. PATENT DOCUMENTS

| | | | |
|---|---|---|---|
| 6,098,222 | A | 8/2000 | Hand et al. |
| 6,190,337 | B1 | 2/2001 | Nedwell |
| 6,193,677 | B1 | 2/2001 | Cady |
| 6,352,518 | B1 | 3/2002 | nee Wolf |
| 6,478,755 | B2 | 11/2002 | Young |
| 6,547,749 | B2 | 4/2003 | Hansen |
| 6,702,769 | B1 | 3/2004 | Fowler-Hawkins |
| 6,736,785 | B1 | 5/2004 | Van Brunt |
| 6,958,047 | B2 | 10/2005 | DeVlieger |
| 2002/0014235 | A1 | 2/2002 | Rogers et al. |
| 2002/0016560 | A1 | 2/2002 | Hansen |
| 2002/0111571 | A1 | 8/2002 | Warwick et al. |
| 2004/0097842 | A1 | 5/2004 | Van Brunt et al. |
| 2004/0097843 | A1 | 5/2004 | Van Brunt et al. |
| 2004/0097844 | A1 | 5/2004 | Van Brunt et al. |
| 2004/0097845 | A1 | 5/2004 | Van Brunt |
| 2004/0097846 | A1 | 5/2004 | Van Brunt et al. |
| 2004/0097847 | A1 | 5/2004 | Van Brunt et al. |
| 2004/0097849 | A1 | 5/2004 | Van Brunt |
| 2004/0097850 | A1 | 5/2004 | Plante |
| 2004/0158177 | A1 | 8/2004 | Van Brunt et al. |

FOREIGN PATENT DOCUMENTS

| | | |
|---|---|---|
| WO | WO 01/24698 | 4/2001 |

OTHER PUBLICATIONS

Rutland, J. & Cole, P.K., "Nasal mucociliary clearance and ciliary beat frequency in cystic fibrosis compared with sinusitis and bronchiectasis" (abstract) (1981) Thorax 36: 654-658.

Sharma, Girish, "Primary Ciliary Dyskenesia" (excerpt) eMedicine: http://www.emedicine.com/ped/byname/primary-ciliary-dyskinesia.htm (accessed on Sep. 27, 2005).

Thomas, J., Cook, D.J. & Brooks, D., "Chest Physical Therapy Management of Patients with Cystic Fibrosis" (1995) Am. J. Respir. Crit. Care Med. 151:846-850.

CHEST VIBRATING DEVICE

CROSS REFERENCE TO RELATED APPLICATION

This application is a Continuation-In-Part of pending U.S. patent application Ser. No. 10/065,307, filed Oct. 2, 2002.

FIELD OF THE INVENTION

The present invention generally relates to a therapeutic device for use by people with cystic fibrosis or other conditions which obstruct the air ways and/or the lungs. Additionally, the present invention relates to a method to assist in loosening obstructions in the air ways and/or lungs of human users.

BACKGROUND OF THE INVENTION

In healthy individuals, clearance of mucus from the respiratory tract is accomplished primarily by the body's normal mucociliary action, coupled with coughing. Under normal conditions these mechanisms are very efficient; the mucociliary transport system continually transports a layer of mucus secreted in the lungs up the trachea and out of the respiratory system to be swallowed, while coughing displaces larger blockages. The mucociliary transport system depends upon cilia, small cytoplasmic extensions of cells lining the inside of the respiratory system. Cilia rhythmically move side to side, progressively shifting the layer of mucus to the trachea. Ciliary movement has a predictable rate (the Cilia Beat Frequency (CBF)), which in healthy individuals has a frequency of about 10-30 beats per second. Impairment of the normal mucociliary transport system (slowing the CBF below 10 beats per second) or hypersecretion of respiratory mucus results in an accumulation of mucus and debris in the lungs which may lead to severe medical conditions such as hypoxemia, hypercapnia, chronic bronchitis, and pneumonia. These conditions diminish quality of life, and may even prove fatal. Many medical conditions can produce abnormal respiratory mucus clearance, including pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants, and viral infections also inhibits mucociliary function. Post surgical patients, paralysed persons, and newborns with respiratory distress syndrome also exhibit reduced mucociliary transport. Respiratory system blockages also occur in patients suffering from emphysema, tuberculosis, and disorders caused by many other pathogens which affect the respiratory system.

Chest physiotherapy (CPT) is used to enhance respiratory mucus transport. CPT may include mechanical manipulation of the chest, postural drainage with vibration, directed cough, active cycle of breathing, and autogenic drainage. External manipulation of the chest and respiratory behavioural training are accepted practices according to the American Association for Respiratory Care Guidelines, 1991. CPT involves a caregiver "clapping" or pounding on the chest and back over each lobe of the lungs, coupled with inhalation therapy. A typical CPT session requires half to three-quarters of an hour. While the mechanism by which CPT clears mucus is not entirely clear, the pounding dislodges air way secretions which drain towards the mouth and are removed by active coughing. Various kinds of CPT are often combined by physicians when designing regimes to enhance mucus clearance.

Cystic fibrosis (CF) is one important disorder in which CPT is used to help clear air ways or lungs. Cystic fibrosis (CF) is an inherited life-threatening genetic disease among Caucasians, afflicting about 1 in 600 children. One in twenty five persons of European descent carry the mutation which causes CF. This genetic defect disrupts cellular chloride ion transfer, causing mucus from the exocrine glands to become abnormally thick and sticky, eventually blocking passages within the pancreas, lungs, reproductive organs, and liver. Disruption of the pancreas inhibits enzyme secretion, sometimes resulting in osteoporosis. Thick mucus may block reproductive tracts, in particular lowering male fertility. Crucially, the thick mucus accumulates in the lung's respiratory tracts, causing chronic infections, scarring, and decreased vital capacity. Normal coughing is not sufficient to dislodge these mucus deposits. CF symptoms usually appear during the first 10 years of life, typically in infancy, and significantly reduce life expectancy. However, with advances in digestive enzyme supplementation, anti-inflammatory therapy, chest physical therapy, and antibiotics, the median life expectancy currently exceeds 30 years, and some patients live into their 50's and beyond. While some patient mortality results from severe gastrointestinal disruptions, the majority of CF patients (90 percent) ultimately succumb to respiratory system failure.

Most CF patients use CPT once to four times a day as part of their standard preventative care program to maintain vital capacity and inhibit infection. CPT requires the assistance of a second individual, ideally a nurse or respiratory therapist, but more typically a family member. Effective CPT requires precise pounding, and CPT is exhausting for the CF patient and caregiver. A tired or inaccurate caregiver often only provides incomplete relief. CF patient dependence upon a second individual to perform CPT severely limits the independence of the CF patient. Additionally, pounding involves sharp blows, which can bruise patients, and may even break bones, particularly in small children and CF patients who suffer from osteoporosis.

Over the past several decades, a diverse assortment of devices have attempted to provide an alternative to caregiver delivered CPT for persons suffering from disorders which obstruct lungs or air ways, including CF. CPT replacement devices typically mobilize and clear mucus by creating chest wall oscillations analogous to those experienced by a patient undergoing manual CPT. These devices differ in the kind of force applied and any resulting motion experienced by the subject, and by whether the force is administered locally, over a large area, to the entire chest, or the entire body. Inventions apply force by repeated chest constriction, chest vibration, and impact or blow-like forces (percussion) to the entire patient, or specific locations.

Most marketed devices address lung congestion by pneumatically generated vibrations. These devices are usually large and restrict user mobility, and fail to target the lower lobes of the lungs, the typical infection start point.

Percussion based devices have been described in the literature. Strom et al., in U.S. Pat. No. 4,508,107, discloses a hand-held pneumatic impact system, and Mulligan et al., in U.S. Pat. No. 5,261,394 describe a chest pack containing two reciprocating arms which simultaneously strike the user's chest on either side of the sternum. Percussion based devices possess many of the drawbacks associated with manual CPT therapy, the sharp impacts can injure young or frail patients, and therefore these devices are not suitable in all cases. Furthermore, the strength of the impacts and associated recoil makes manipulation and control of these devices inherently difficult.

A number of commercially available lung clearing devices use constriction, a repeated squeezing and release of the entire chest region. Constriction may be provided by a variety of means. Certain apparatus, such as the commercially available Vest Airway Clearance System ("The Vest™") distributed by Hill Rom, a subsidiary of Hillenbrand Industries, Inc. (described in Van Brunt et al., U.S. Pat. No. 5,769,797 and numerous other patents) apply pressure to the patient's chest pneumatically. The Vest contains air bladders which are periodically pressurized and depressurized by an external air pressure system, repeatedly squeezing the chest at a frequency of 5-20 Hz. Another vest apparatus with a distinct pneumatic pressure source, operating at 5-25 Hz, is described by Hansen, see for example U.S. Pat. No. 6,547,749. The device described in Van Brunt, U.S. Pat. No. 6,736,785 creates analogous patient body motions via a mechanism cyclically squeezing the subject's chest with an inflexible circumferential chest band. Arbisi et al., in U.S. Pat. No. 5,235,967 describe forces being applied to a subject by repulsion between numerous electromagnets mounted within a flexible vest or shirt like garment, the magnetic repulsion pressing a layer of electromagnets onto the subject. All these apparatus apply force over the entire chest, typically by surrounding the chest in a garment, and then repeatedly squeezing inward. These inventions are often bulky, for example, the pneumatic vests require a large external pressure source. Patients undergoing constriction based therapy often have difficulty breathing due to the way these devices compress the chest.

A wide variety of hand-held vibrators have been described for treating CF patients and other respiratory ailment sufferers. These devices may rhythmically pound the chest at high rates (ex. Denton et al. U.S. Pat. No. 4,079,733, preferably impacting the chest at 115 Hz), move parallel to the surface of the subject (ex. Muchinsky et al., U.S. Pat. No. 4,098,266), or both at once (ex. Muchinsky et al., U.S. Pat. No. 4,102,334). Many of these hand-held units are not particularly portable, and have a large external mechanical power source. Additionally, these hand-held vibrators require an attendant to maintain the device in contact with the patient, and press the vibrator against the patient. Since these devices inherently move and vibrate, the person holding the vibrator must overcome these motions to keep the hand-held vibrator in place, an effort that can be tiring and inconvenient. Larouche et al., in U.S. Pat. No. 5,167,226, discloses a combined clapping and vibrating device where a nominally hand-held device is only practical once mounted on a bed by a supporting arm, presumably to address this problem. With hand-held vibrations, treatment is local and the user must reposition the vibrator from chest area to chest area, resulting in lengthy and potentially incomplete treatment sessions.

Other devices which assist clearing lungs and air ways vibrate the entire subject, or the subject's chest. One strategy involves submerging the subject in a bath, then transmitting vibrations from a source such as a audio speaker to the subject via the fluid (see for example Nedwell, U.S. Pat. No. 6,190,337, Rogers et al., U.S. patent application Ser. No. 2002/0014235, published Feb. 7, 2002). Obviously, these vibrators are large and essentially immobile, and impractical for daily home use. Vibrating beds such as the pneumatic design described in Hand et al. (U.S. patent application Ser. No. 2002/0195144, published Dec. 26, 2002) have similar limitations.

Another approach is to vibrate the air within the patient, rather than the patient's body (see for example Gibson, UK Patent No. 2,196,585, Jam, U.S. patent application Ser. No. 2004/0069304, published Apr. 15, 2004, Benarrouch, et al., U.S. Pat. No. 6,176,235, Fowler-Hawkins, U.S. Pat. No. 6,702,769). One variant of this approach has been marketed by Scandipharm as "The Flutter™". The Flutter uses the patient's breath to oscillate a ball bearing, creating vibrations which are then transmitted down the patient's air ways. This technique is limited by the strength at which the patient's breath can oscillate the ball bearing, a potentially serious limitation when treating patients suffering from chronic respiratory illness. Furthermore, these techniques transmit vibrations by air, a much less mechanically efficient vibration transmission method than vibration transmission through solids.

There remains a need for a device which adequately provides a replacement for manual CPT, allows patient independence, and provides rapid, efficient, and consistent treatment.

SUMMARY OF THE INVENTION

In one embodiment, the invention broadly provides a chest vibrating device including a frame (i.e. rigid frame), shoulder pads, chest pad (i.e. front pad) and back pad. The frame is configured to fit around an upper body of a user. The shoulder pads extend from the frame to rest the frame on shoulders of the user. The chest pad extends from a front inside of the frame towards the chest of the user. The back pad extends from the rear inside of the frame towards the back of the user. A vibrating unit is attached to the frame and produces a vibration that travels from the vibrating unit, through the frame onto the chest pad and at least one back pad.

In a second embodiment, broadly stated, the invention provides a vibrating device for assisting in loosening of obstructions in the lungs or air way of a human user. The vibrating device includes: a rigid frame for positioning and clamping around the user's chest; a plurality of pads connect to, and extending inwardly from, the rigid frame to contact the chest from opposite sides of the chest when the frame is clamped around the user's chest; and a vibrator connected to the rigid frame, the vibrator generating and imparting vibrations sufficient to transfer through the rigid frame and pads to the user's chest to assist loosening of obstructions in the lungs or air way of the user.

Through testing of the device of the present invention with CF patients, it was surprisingly discovered that the device was effective when the vibrations imparted to the rigid frame had a frequency sufficient to stimulate the user's cilia beat frequency (CBF) to assist in loosening of obstructions in the lungs or air way. Preferably, this frequency is greater than 10 Hz, more preferably at 11 to 20 Hz, and most preferably in a range of 13 to 16 Hz. Also discovered during testing of the device was that the amplitude of the vibrations to be effective in transferring vibrations through to the chest is preferably in the range of about 0.1 to 2 mm.

Preferably, one or more of the plurality of pads are connected to the rigid frame in an adjustable manner to adjust their position and/or orientation to accommodate users of differing size and gender. In one embodiment, the one or more of the adjustable pads may be adjusted in a lateral to medial direction, and/or the one or more of the adjustable pads are connected to the rigid frame through a pivoting or a ball and socket connection to adjust orientation.

In the preferred embodiment of this invention, the vibrator is an off-set weight mounted for rotation by a motor. Preferably, the motor and the off-set weight are oriented to rotate the off-set mass around an axis parallel to a medial to lateral axis of the user's chest.

Preferably, the vibrating device has a plurality of pads which include: one or more pairs of back pads positioned to contact the back of the user on either side of the spine; and a plurality of front pads including an upper front pad positioned to contact the front of the user over the sternum, and one or more pairs of lower front pads positioned to contact the front and/or sides of the user's chest near the lower lobes of the lungs. As well the device further comprises shoulder pads connected to, and extending radially inwardly from, the rigid frame, and positioned to contact the user's shoulder to support the vibrating device when the user is sitting or standing upright.

Another broad aspect of the invention provides a method to assist in loosening of obstructions in the lungs or air way of a human user. The method includes: positioning and clamping a rigid frame around the user's chest such that the chest is clamped within the rigid frame from opposite sides of the user's chest; generating vibrations; and imparting the vibrations through the rigid frame to the user's chest to assist in loosening obstructions within the lungs or air way of the user.

This invention has significant advantages over both mechanical and care-giver administered CPT techniques. As a second party (a caregiver) need not be involved when using this vibrating device, the respiratory ailment patient has considerably greater independence and can schedule treatments with greater flexibility. In the preferred embodiment of this invention, the vibrating device is sufficiently light and small that the vibrating device may be worn by a standing or sitting user, and does not require a second person to enter, exit, or operate the device.

Furthermore, this invention provides consistent, uniform treatment not dependent upon personnel who may have limited familiarity with CPT techniques, or upon a caregiver who becomes fatigued during lengthy CPT sessions. Since the patients themselves control the rotation of the off-set weight and the resulting vibration frequency, the user may fine-tune their treatment to match their particular needs and physical characteristics.

Unlike the localized application of force applied during manual CPT procedures and by many percussion devices, this invention transmits vibrations to the entire chest through an array of pads which cover broad areas of the user's chest, thereby avoiding impact injuries such as bruising, or broken bones. As a result, patients too young or ill to receive impact-based CPT may safely use this invention. Unlike hand-held devices in which each area of the chest and respiratory system are individually vibrated, this invention vibrates the entire chest and therefore leads to treatment sessions of shorter duration.

Since this invention may be embodied in a single, self-contained unit worn by a user, the vibrating device is considerably more convenient than many alternative lung clearing vibration devices. For example, the The Vest™ requires a bulky external pneumatic pressure source, and liquid filled vibration tanks are, by necessity, large fixed instillations. Similarly, other vibrating devices are essentially beds. The vibrating device of this invention may be embodied in a form which is sufficiently small and light that the user may walk about and engage in other activities while undergoing treatment.

An additional advantage of this invention is that the user need not hold and manipulate the vibrating apparatus while in use, thereby avoiding operator fatigue. The vibrating device does not require any user effort to maintain vibrator to chest contact, as the frame clamps the various pads against the user.

Through testing of the device of the present invention with CF patients, it was discovered that while using this invention, users may breath freely and deeply, without the device significantly impairing their lung vital capacity. The constrictive forces associated with chest compression devices such as The Vest may restrict users from engaging in the full range of chest motions required for deep breathing up to the user's vital capacity. Additionally, when wearing the device of the present invention, the user may continue to vibrate their chest while coughing to remove certain smaller lung and air way obstructions. To remove larger obstructions, the user only needs to temporarily stop the device's vibrations, then cough without ever having to remove the device from the chest. In contrast, a treatment session with a chest compression device may require the user remove the device on one or more occasion, breath deeply and cough to mobilize and remove lung and air way obstructions, then replace the device and resume treatment. Treatment using the present invention may result in shorter treatment sessions.

The term "chest" as used herein and in the claims refers to the part of the human skeleton and musculature, including the diaphragm, which surrounds the pleural cavity and encloses the lungs.

The term "medial to lateral" as used herein and in the claims refers to either a direction of movement or an axis relative to the chest or body of the user where the referenced movement is parallel to the axis through the shoulders of a human user, and where the referenced axis is parallel to the axis through the shoulders of a human user.

The phrase "opposite sides of the chest" as used herein and in the claims refers to locations on the chest which are generally on opposite sides of the human chest skeleton and musculature, for example the front and back, or the two sides, and is not limited to locations on the human chest which are diametrically opposed.

As used herein and in the claims, the terms "vertical" and "horizontal", "upper" and "lower", "right" and "left", "front", "side" and "back", "top" and "bottom" and other like terms refer either to the terms conventional meaning with reference to the user's chest or body when the user is standing upright, or refer to an apparatus positioned around a user's chest, the term's meaning defined by the terms conventional meaning with reference to the user's chest or body when the user is standing upright.

As used herein and in the claims, the word "comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

DESCRIPTION OF THE PREFERRED EMBODIMENTS

Figure 1:
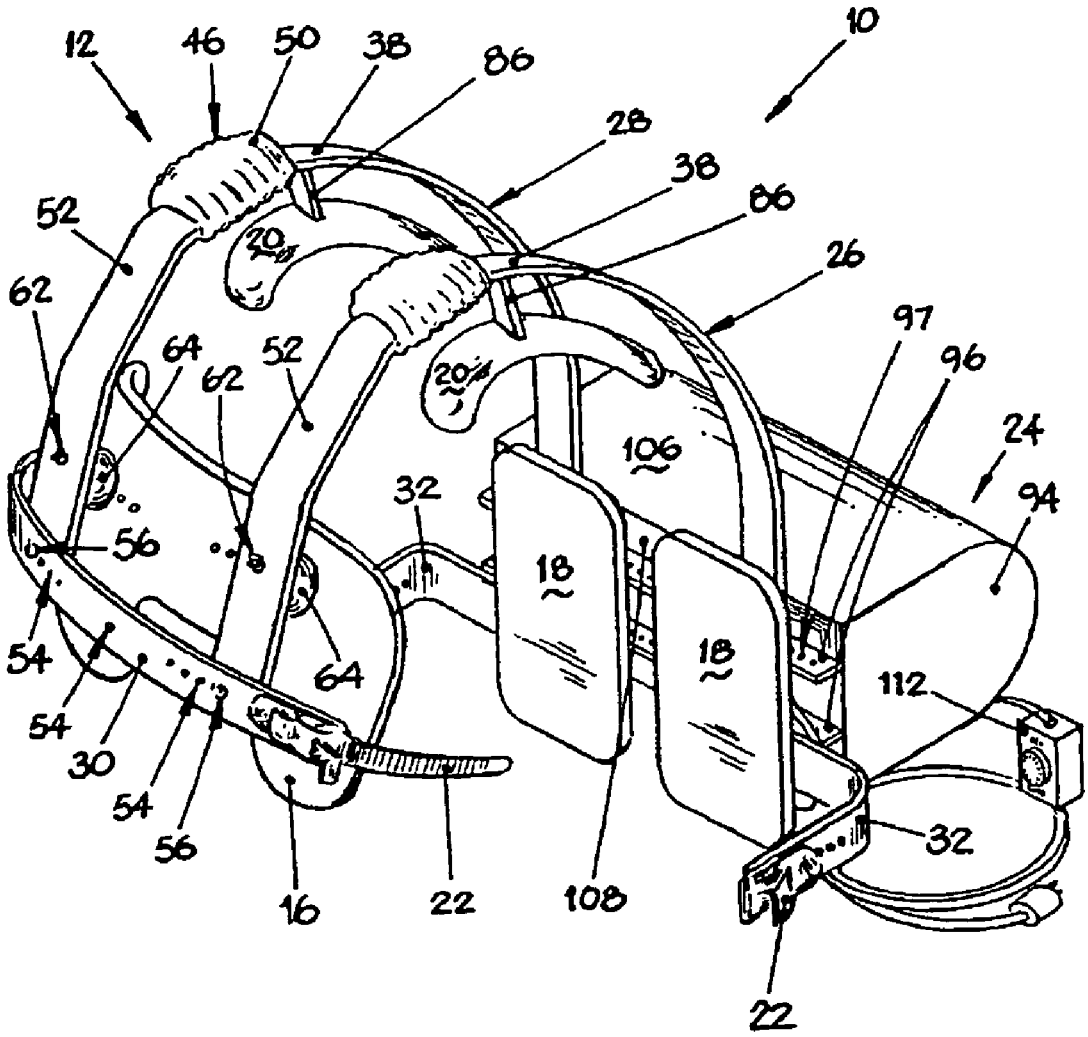
FIG. 1 is a perspective view of a chest vibrating device according to the present invention.

A first embodiment of the present invention is shown in FIGS. 1-7 to include a chest vibrating device 10, to be attached to the user. The chest vibrating device 10 includes a frame 12, chest pad (i.e. front pad) 16, back pads 18, shoulder pads 20, clamping unit 22 and vibrating unit 24. The chest vibrating device 10 vibrates, and by virtue of the rigid frame, pad placement, and clamping, transfers the vibrations through the frame and the pads to the lungs of the user. This clears the lungs by loosening obstructions in the air ways. The chest vibrating device 10 is fully adjustable to fit all sizes and can be fitted for both male or female users. While the chest vibrating device 10 can be used particularly for people with cystic fibrosis, it has broad application for users with other lung conditions and/or obstructed air ways.

Figure 2:
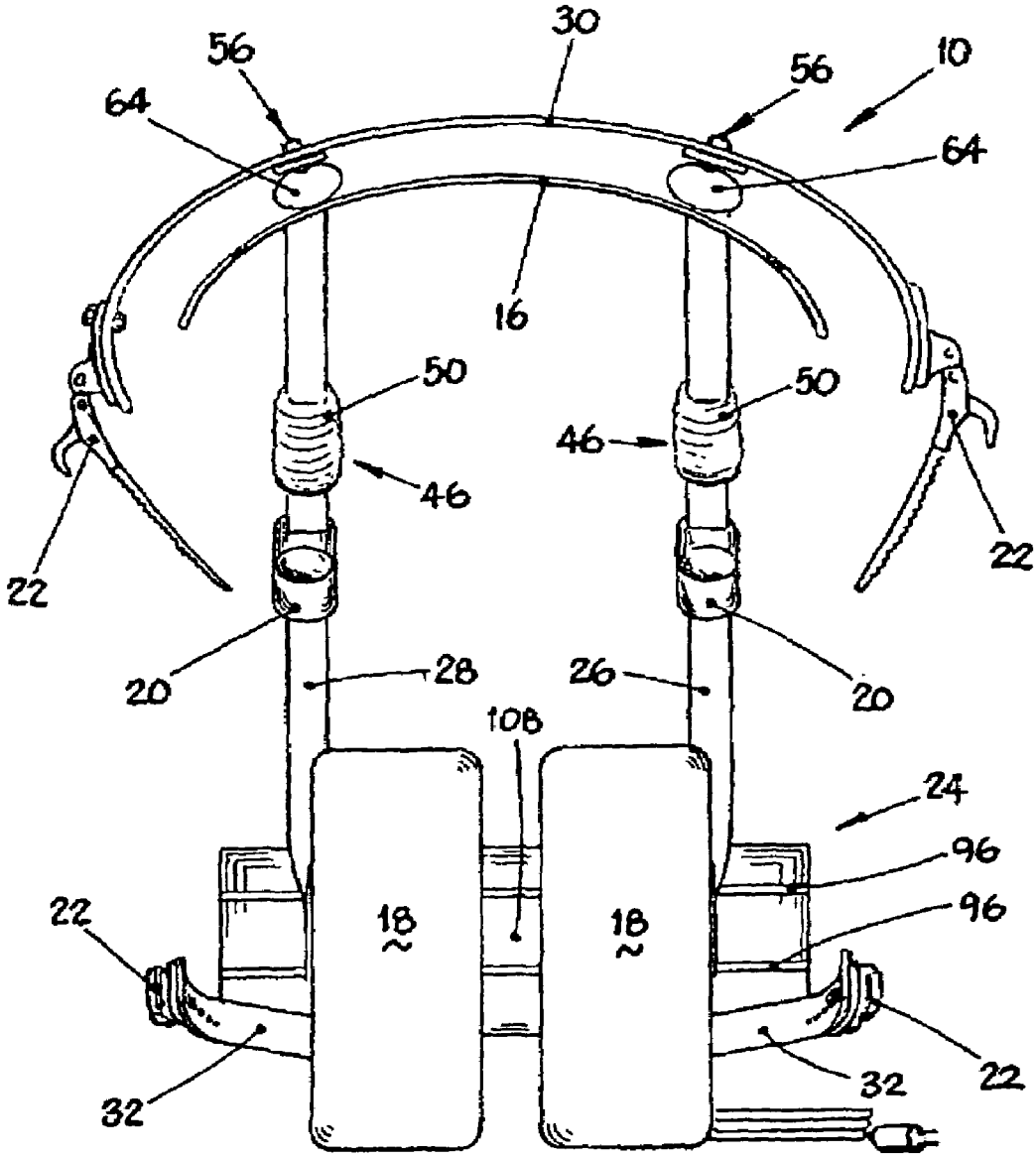
FIG. 2 is a front view of a chest vibrating device according to the present invention.
Figure 3:
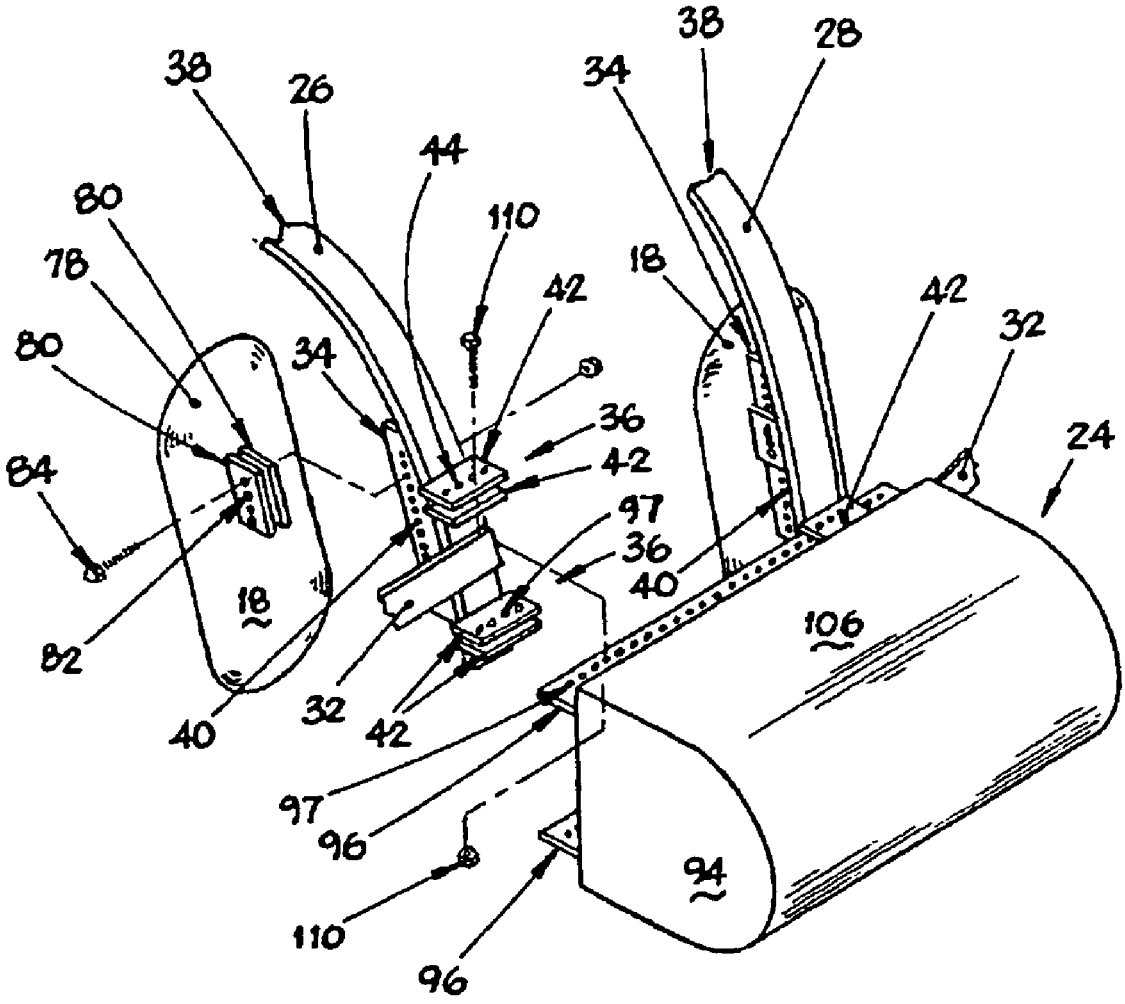
FIG. 3 is a partial rear exploded view of a chest vibrating device according to the present invention.
Figure 4:
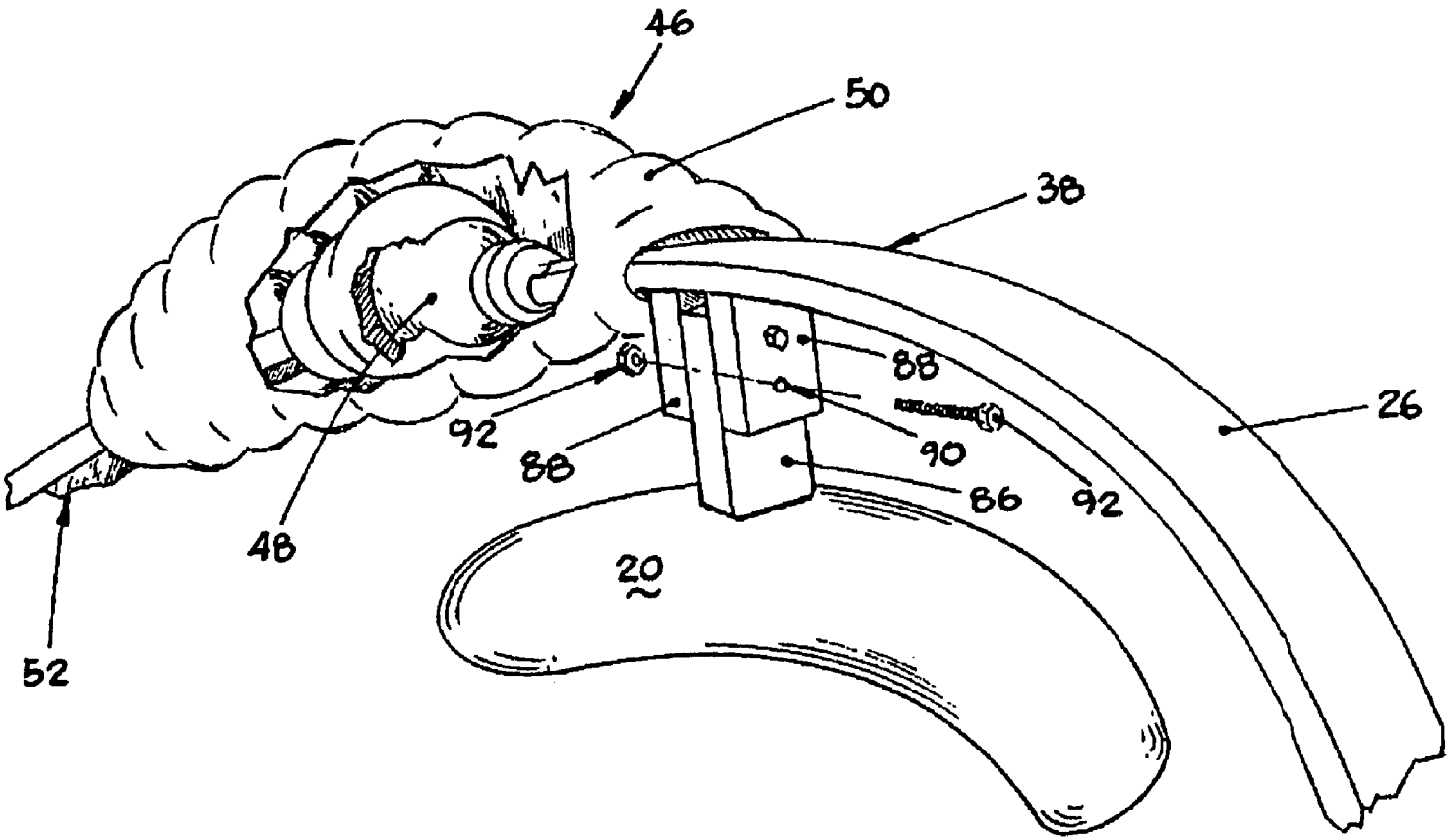
FIG. 4 is a partial cutaway perspective view of a hinge and shoulder pad according to the present invention.
Figure 5:
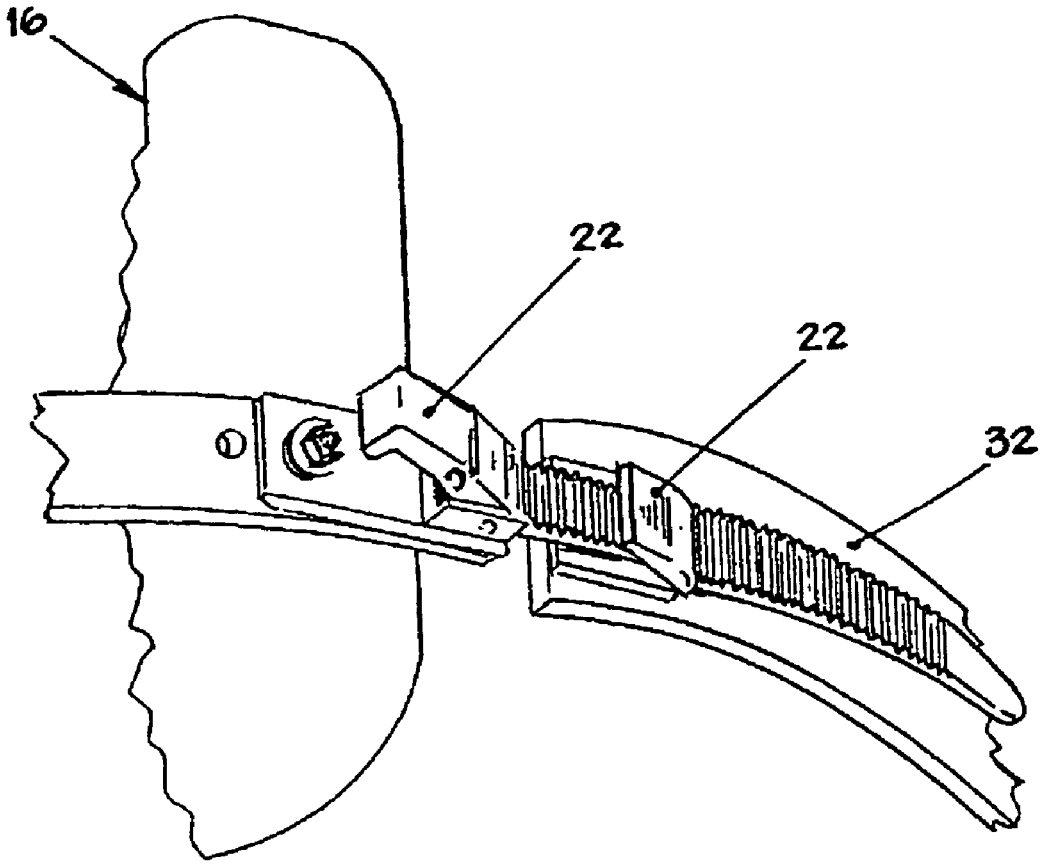
FIG. 5 is a partial perspective view of a clamping unit according to the present invention.

The frame (i.e. rigid frame) 12 includes a left arm, right arm, cross-member 30 and clamp support 32. The left and right arms 26, 28 each include back pad rails 34 and housing rail receivers 36. As shown in FIG. 3, each back pad rail 34 extends from an inside surface of the left and right arms 26, 28 at the rear half 38 of the frame 12 to connect to the back pads. Each back pad rail 34 includes a plurality of holes 40 along the back pad rail 34. Each housing rail receiver 36 is a pair of rails 42 extending outward from the left and right arms 26, 28 at the rear half 38 of the frame 12 and includes a plurality of aligned holes 44. The left and right arms 26, 28 each include a hinge 46 along their length at about the half way point, as shown in FIGS. 1-2 and 4. The hinges 46 allow the opening and closing of the frame 12 for entrance by the user. FIG. 4 shows the employment of a ball hinge 48 and a flexible hinge cover 50. The hinge cover 50 is used to reduce wear, for aesthetic reasons, and for safety of the user. The cross-member 30 is attached to the front half 52 of the left and right arms 26, 28. As shown in FIG. 1, the cross-member 30 includes holes 54 to allow the adjustment of positioning of the left and right arms 26, 28. Fasteners 56 are used to attach the cross-member 30 to the left and right arms 26, 28. The left and right arms 26, 28 also include clamp supports 32 attached to the rear half 38 of the left and right arms 26, 28. The clamp supports 32 extend from the rear and towards the front of the frame 12. A clamping unit 22 is attached to the cross-member 30 and the clamp support 32 on each side of the frame 12. The clamping unit 22 is fully adjustable to various size users. The clamping unit 22 shown in FIGS. 1-2 and 5-6 is similar to belt-buckle combinations used in ski boots and in-line skates.

Figure 6:
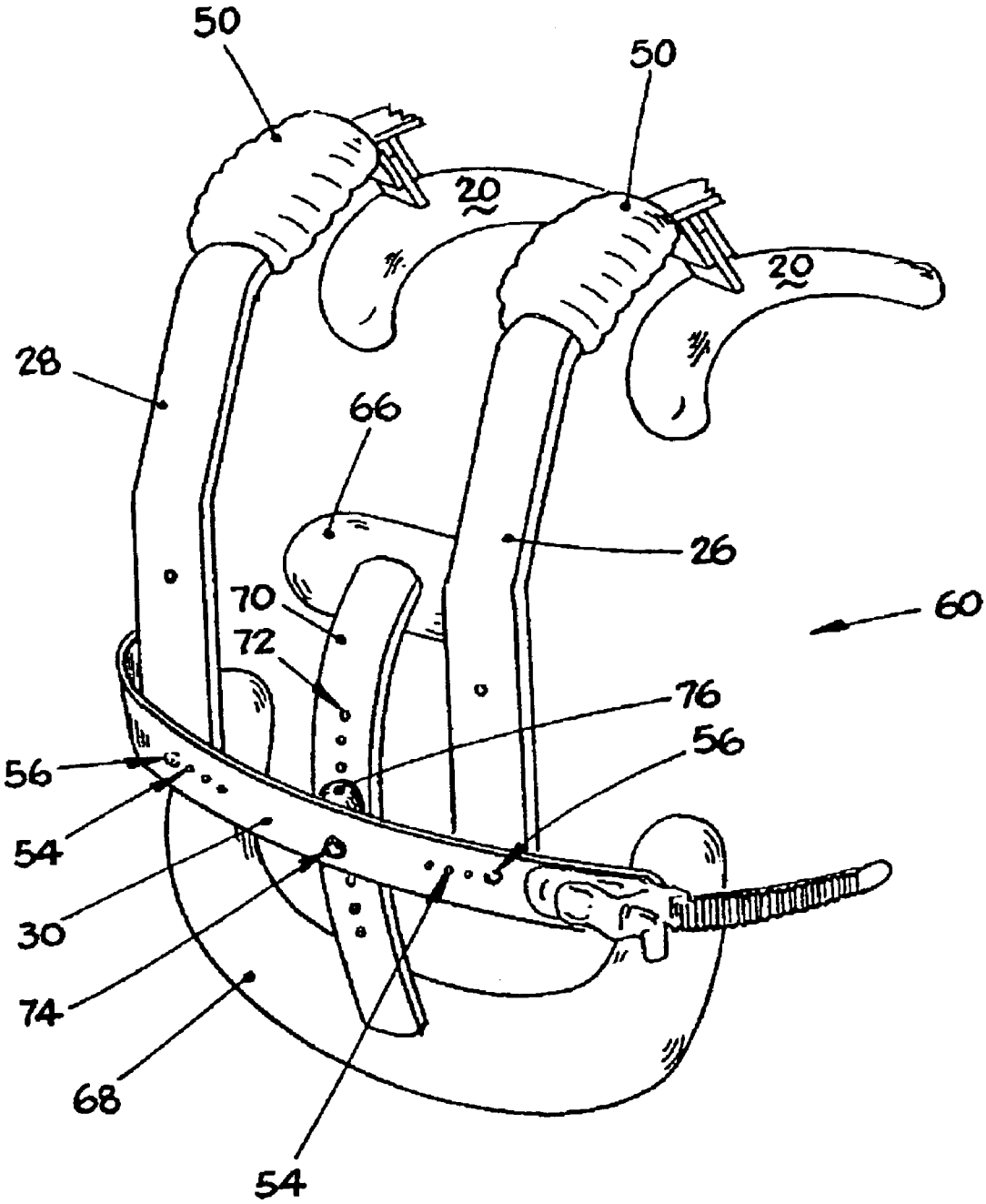
FIG. 6 is a partial perspective view of a female version chest pad according to the present invention.
Figure 7:
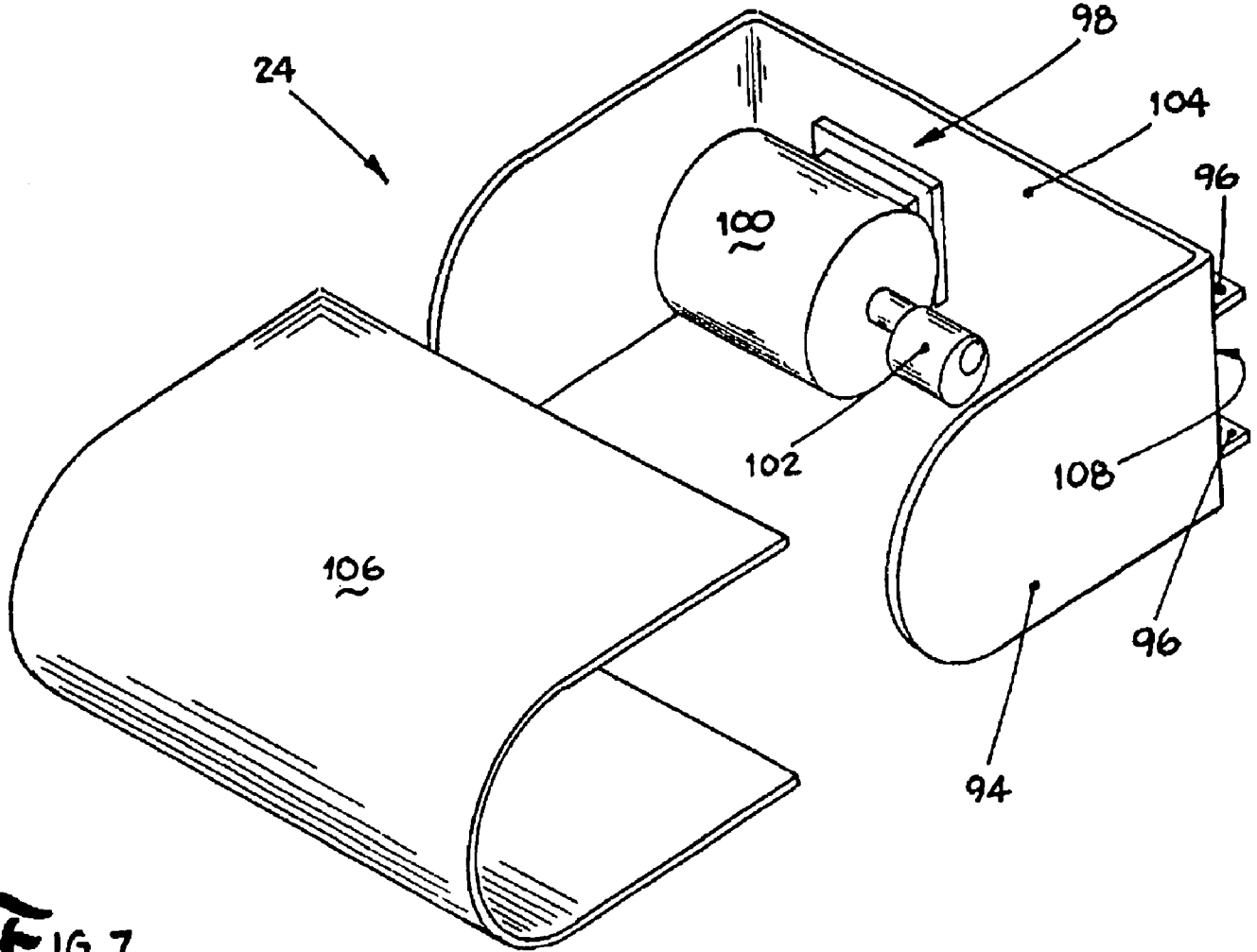
FIG. 7 is an exploded view of a vibrating unit according to the present invention.
Figure 8:
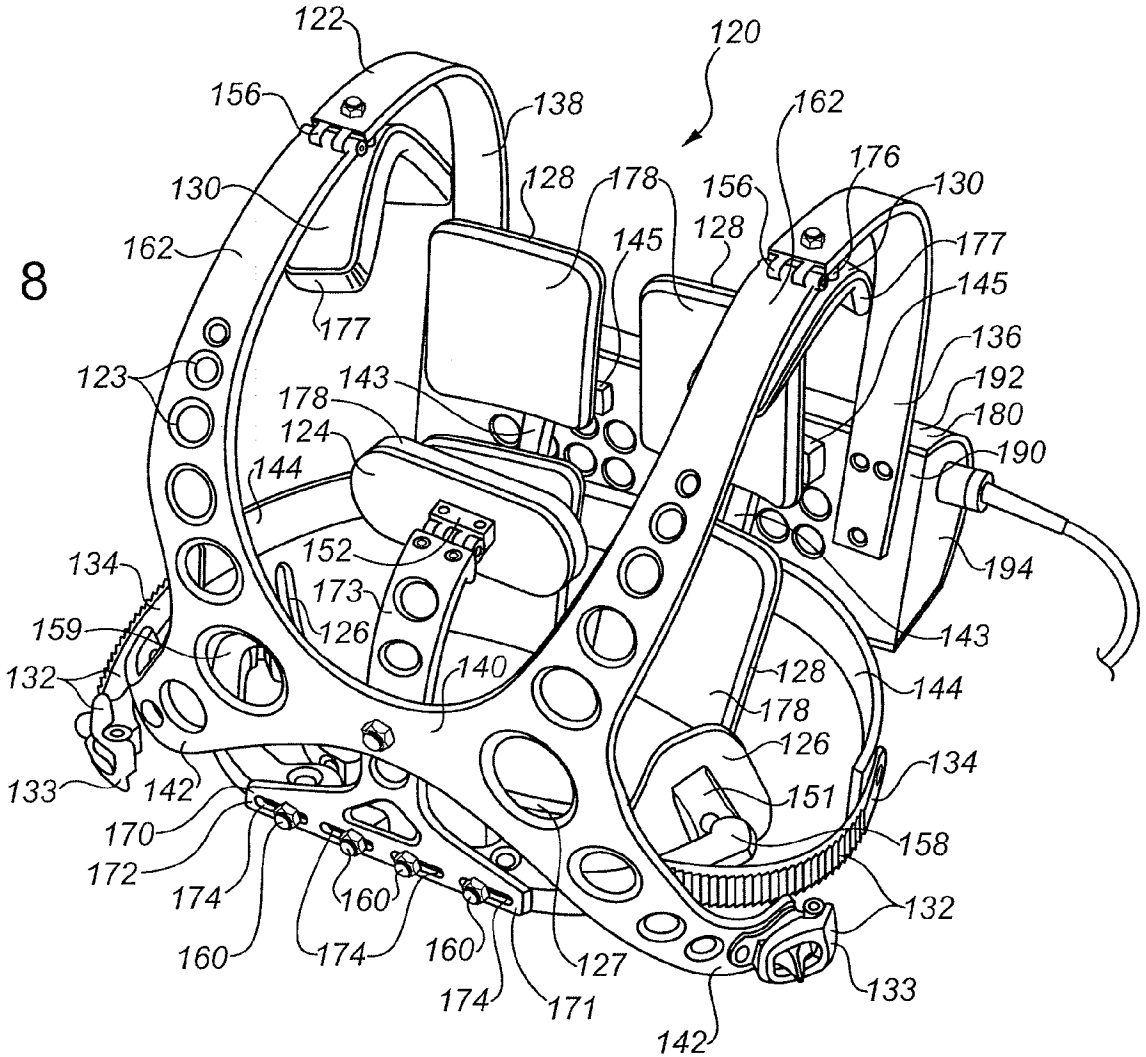
FIG. 8 is a front perspective view of a further embodiment of a chest vibrating device of the present invention.

FIGS. 1-2 show a male version of the chest pad 16 and FIG. 6 shows a female version of the chest pad 60. The male chest pad 16 is mounted to the inside front half 52 of the left and right arms 26, 28 using fasteners 62 and rubber mounts 64. The male chest pad 16 is sized such that the chest pad 16 extends down to vibrate the lower lobes of the lungs. The female chest pad 60 includes an upper pad (i.e. upper front pad) 66, lower pad (i.e. lower front pad) 68 and pad bar (i.e. pad support bar) 70. The upper pad 66 is connected to the top of the pad bar 70. The lower pad 68 is connected to the bottom of the pad bar 70. The pad bar 70 includes adjustment holes 72 and is connected to the cross-member 30 using fasteners 74 and rubber mount 76. The upper pad 66 is sized to produce vibrations in the top of the lungs. The lower pad 68 is sized to produce vibrations that reach not only the front of the lower lungs, but also the sides of the middle and lower lobes. The pad bar 70 is curved to wrap around the chest of a female.

The back pads 18 are sized to reach from the upper to the lower lobes of the lung. The back pads 18 include back pad rail receivers 78, as shown in FIG. 3. Each back pad rail receiver 78 is a pair of rails 80 extending outward from the rear of the back pads 18 and includes a plurality of aligned holes 82. The back pads 18 are mounted to the left and right arms 26, 28 by sliding the back pad rails 34 between the rails 80 of the back pad rail receiver 78. Then, one of the holes 40 of the back pad rail 34 is aligned with a set of aligned holes 82 of the back pad rail receiver 78 and a fastener 84 is inserted to secure the back pads 18 to the left and right arms 26, 28. The shoulder pads 20 are curve shaped to fit over the shoulders of the user and include shoulder pad supports 86, as shown in FIGS. 1 and 4. The shoulder pad 20 are designed to transfer the weight of the invention to the shoulders of the user. The shoulder pads 20 should be padded for comfort of the user. FIG. 1 shows the shoulder pad supports 86 attached permanently using a technique such as welding, while FIG. 4 shows the shoulder pad supports 86 mounted between two plates 88 extending from the left and right arms 26, 28. The mounting as shown in FIG. 4 includes holes 90 through the two plates 88 and the shoulder pad support 86 and fasteners 92 are used to connect the two plates 88 and the shoulder pad support 86. The chest pad 16, back pads 18 and shoulder pads 20 can include a coating that moulds to the shape of the user for comfort.

The vibrating unit 24 is shown in FIGS. 1-3 and 7. The vibrating unit 24 includes a housing 94, housing rails 96 and vibrator 98. The vibrator 98 is shown as a motor 100 which rotates an off-set weight 102 to cause vibrations. The motor 100 is usually of the type that runs on 12 Volt DC or 120 Volt AC. The motor 100 is mounted to the inside back 104 of the housing 94. The housing 94 includes a housing cover 106 for safety. The housing rails 96 extend outward and along the outside back 108 of the housing 94. The vibrating unit 24 is mounted to the frame 12 by inserting housing rails 96 between the rails 42 of the housing rail receivers 36 of the left and right arms 26, 28, and fastening using fasteners 110 through holes 97. The vibrations generated by the vibrator 98 are transferred through the housing 94 and the housing rails 96 onto the frame 12 and then to the chest and back pads 16, 18.

The operation of the chest vibrating device 10 is as follows. The user adjusts the position of the left and right arms 26, 28 along the housing rails 96 and cross-member 30 for proper sizing. The user lifts the front half 52 of the left and right arms 26, 28 upward along the hinges 46 to enter the frame 12. Then, the user slips into the frame 12 and closes the front half 52 of the left and right arms 26, 28 along the hinges 46. Finally, the user uses the clamping unit 22 to secure the frame 12 about the user, such that the chest pad 16 and back pads 18 are pressured against the user. The chest vibrating device 10 can then be turned on to create vibrations. The vibrations transferred to the chest and back pads 16, 18 are passed onto the lungs through the chest and back of the user. As shown in FIG.

1, the chest vibrating device 10 can include a controller 112 to vary the intensity of the vibrations (i.e. the rate of rotation of the motor) to create different strengths (i.e. frequencies) of vibrations to clear secreted mucus from the lungs.

A second embodiment of present invention shown in FIGS. 8-12 and includes a chest vibrating device 120 to be attached to a user, to assisting loosening of obstructions in the lungs or air way of a human user. The chest vibrating device 120 can be used with humans with lung or air way conditions which involve obstructed air ways or a reduced CBF that results in inadequate mucus transport, including CF. The chest vibrating device 120 includes a rigid frame 122, an upper front pad 124, side lower front pads 126, lower front pads 127, back pads 128, shoulder pads 130, clamping units 132, and a vibrator 182. The frame 122 is shaped to be positioned and clamped around the user's chest. The pads 124, 126, 127, 128 are connected to the frame 122 so as to extend radially inwardly from the frame such that the pads are positioned to contact the user's chest from the opposite sides of the chest, when the frame 122 is clamped around the user's chest. The vibrator 182 is connected to the frame 122, and is operative to generate vibrations sufficient to transfer through the frame 122 and pads 124, 126, 127, 128, impart the vibrations to the user's chest, and thereby assist in loosening obstructions in the lungs or airways of the user. The pads 124, 126, 127, 128, 130, and rigid frame 122 are manufactured from a material such as metal which is sufficiently rigid to efficiently transfer vibrations to the user's chest. The chest vibrating device 120 is adjustable to persons of varying body size and can be fitted to both male or female users. In the preferred embodiment of this invention, the vibrating device 120 is sufficiently light and small so as to be comfortably worn by a standing or sitting user, and without requiring a second person to assist entering, exiting, or operating the device. Other embodiments of this invention may be used, for example, a stationary device for use in hospital, clinic, or other institutional settings, and may surround and clamp the user's chest while the user in other positions, for example while prone, reclined or recumbent. In such embodiments, a frame is clamped around the chest such that pressure may be applied by the pads to press and hold the appropriate rigid chest bone and muscle structures for effective transfer of the vibrations to the chest with the pads biased against the chest's bone and musculature.

The rigid frame 122 preferably includes a left arm 136, a right arm 138, a cross-member 140, front clamp supports 142, back clamp supports 144, and a vibrator housing 180. The frame 122 may be lightened to improve user comfort by cutting holes 123 in the frame 122 in a manner which retains the rigid frame mechanical strength. The left and right arms 136, 138 each include a hinge 156 along their length at about the half way point. The hinges 156 allow the opening and closing of the frame 122 for entrance and exit by the user. The cross-member 140 connects to the front half 162 of the left and right arms 136, 138. A pair of front clamp supports 142 connect to the cross-member 140 and extend towards the rear of the rigid frame 122, and a pair of back clamp supports 144 attach to the vibrator housing 180 and extend towards the front of the rigid frame 122. In FIGS. 8-11, the cross-member 140, the front half 162 of the left and right arms 136, 138, and the front clamp supports 142 are a single integral unit within the frame 120, so as to more properly be described as a cross-member section, left and right front half arm sections, and front clamp support sections of the frame 122. It will be apparent to those of ordinary skill in the art that alternative frame structures 122 other than those specifically detailed herein can be employed or readily adapted for positioning and clamping around a user's chest, connecting to a plurality of pads which extend radially inwardly to contact the user's chest from opposite sides of the chest when the frame is clamped around the user's chest, and in transmitting vibrations from a vibrator 182 through pads to the user's chest to assist in loosening of obstructions in the lungs or air way of a user.

Clamping units 132 are attached to the clamp supports 140 on each side of the frame 122. In the preferred embodiment, the clamping units 132 are similar to belt and buckle combinations used in ski boots and inline skates, and each clamping unit comprises a clamp buckle 133 attached to a front clamp support 142, and a clamp tongue 134 attached to a rear clamp support 144. Other embodiments of the clamp units are possible. For example, the attachment of the clamp buckle 133 and the clamp tongue 134 to the front and rear clamp supports 142, 144 may be reversed, and it will be apparent to those of ordinary skill in the art that alternative kinds of clamping unit types and alternative clamping unit and clamp support arrangements may be employed or readily adapted to practice this invention. By varying the position at which the clamp buckle 133 is attached to the clamp tongue 134, the clamping units 132 are adjustable to accommodate users of varying size and gender.

Transmission of vibrations from the rigid frame 122 to the user's chest is accomplished by positioning the pads 124, 126, 127, 128 so that the rigid frame 122 clamps the pads onto chest locations such that vibrations are effectively transferred from the frame 122 to the chest. For comfort and effective vibration transfer, the pad surfaces are generally parallel to the user's chest surface. The chest vibrating device is shown to include adjustable features to accommodate the wide variation in human body form and size between and within the genders. In FIGS. 8-11, the position and orientation of the pads 124, 126, 127, and 128 are adjustable.

The invention clamps the user's chest with pads which contact the chest from opposite sides of the chest when the frame 122 is clamped around the user's chest. Preferably, the pads are connected to the frame 122 as follows in order to effectively clamp the device against the bone structure of the user's chest such that pressure can be applied in the clamping, and such that the vibrations can most effectively be transferred to the user's lungs:

- the back pads 128 arranged as pairs on either side of the user's spine to overlie the scapulae and ribs of the user, preferably with two pairs of back pads 128 positioned over the upper and lower lobes of the lungs;
- the upper front pad 124 is arranged to overlie the user's sternum, preferably over the manubrium or upper gladiolus; and
- the lower front pads 126, 127 are arranged as a pair of side lower front pads 126 to overlie the lower side of the rib cage near the diaphragm, and preferably positioned near the sides of the lower lobes of the lungs, and a pair of lower front pads 127 to overlie the lower front of the rib cage near the diaphragm, and preferably positioned near the front of the lower lobes of the lungs.

The weight of the vibrating device 120 is supported on the user by a pair of shoulder pads 130 connected to, and positioned to extend radially inwardly from the frame 122 to the shoulders of standing or sitting users. It will be apparent to those of ordinary skill in the art that alternative pad positions and combinations other than those specifically detailed herein can be employed or readily adapted to allow effective clamping from at least two opposite sides of the user's chest within a frame 122, and to support the vibrating device 120 on the user.

Preferably, the vibrating device 120 has features to accommodate users of differing size and gender. Consequentially, the pads 124, 126, 127, 128 are connected to the frame in an adjustable manner to adjust their position and/or orientation to accommodate users of differing size and gender. The lower front pads 126 and 127 may be adjusted in a lateral to medial direction, and upper front pad 124 may connect to the frame 122 by a pivot 152, and lower front pads 126 and 127, and back pads 128 may connect to the frame by a ball and socket connection 151. In the specific embodiment shown in FIGS. 8-11, each pad 126, 127, 128 connects to the frame by a ball and socket connection 151 in which the ball rotates within a socket which is connected to the back of the pads 126, 127, 128. Other embodiments of the adjustable connections between the pads 124, 126, 127, 128 and frame 122 are possible. For example, each ball and socket connection 151 may instead have the ball connected to the pads, the ball rotating within a socket attached to the frame 122. It will be apparent to those of ordinary skill in the art that alternative kinds of adjustable pad connections may be employed or readily adapted to practice this invention.

In this specific embodiment of FIGS. 8-12, accommodation of users of varying size and gender is achieved as follows. A generally inverse T-shaped front pad support bar 170 is connected on the inside to the cross-member 140 of frame 122. A pair of generally arcuate support bars 158, 159 are connected to the front pad support bar 170 by fasteners 160, the left arcuate support bar 158 being mounted generally horizontally to the left portion 171 of the T-shaped section of the front pad support bar 170, and the right arcuate support bar 159 being mounted generally horizontally to a right portion 172 of the inverse T-shaped section of the front pad support bar 170. One of each of the pair of side lower front pads 126, and one of each of the pair of lower front pads 127 connect to the left arcuate support bar 158 by ball and socket connections 151, and the other side lower front pad 126, and the other lower front pad 127 connect to the right arcuate support bar 159 by ball and socket connections 151, the ball and socket connections 151 allowing for adjustment of the side lower front pads 126, and lower front pads 127 orientation to facilitate contact to the lower side of the user's chest, and the lower front of the user's chest, respectively, near a lower lobe of the user's lungs. The upper front pad 124 is connected to the top portion 173 of the T-shaped front pad support bar 170 through a pivot 152 allowing for movement around a lateral to medial axis to facilitate chest contact over the sternum. As shown in FIG. 10, the fasteners 160 connecting the left and right arcuate support bars 158, 159 to the left and right portions of the T-shaped section 171, 172 of the front pad support bar 170 are positioned in pairs of generally horizontal slots 174 in the left and right portions 171, 172 of the front pad support bar 170. Loosening the fasteners 160 allows the left and right arcuate support bars 158, 159 to slide in a medial to lateral direction to position the side lower front pads 126 and the lower front pads 127 over users of differing size and gender, at which point the fasteners 160 are tightened to hold the arcuate support bars 158, 159 in place. As will be apparent to those of ordinary skill in the art, other embodiments are possible, for example, different numbers of slots 174 and fasteners 160 per arcuate support bar 158, 159 to front pad support bar 170 connection. Alternatives to the arcuate support bars and their connections may be employed or readily adapted to provide lateral to medial adjustability of the pads 126, 127.

Figure 9:
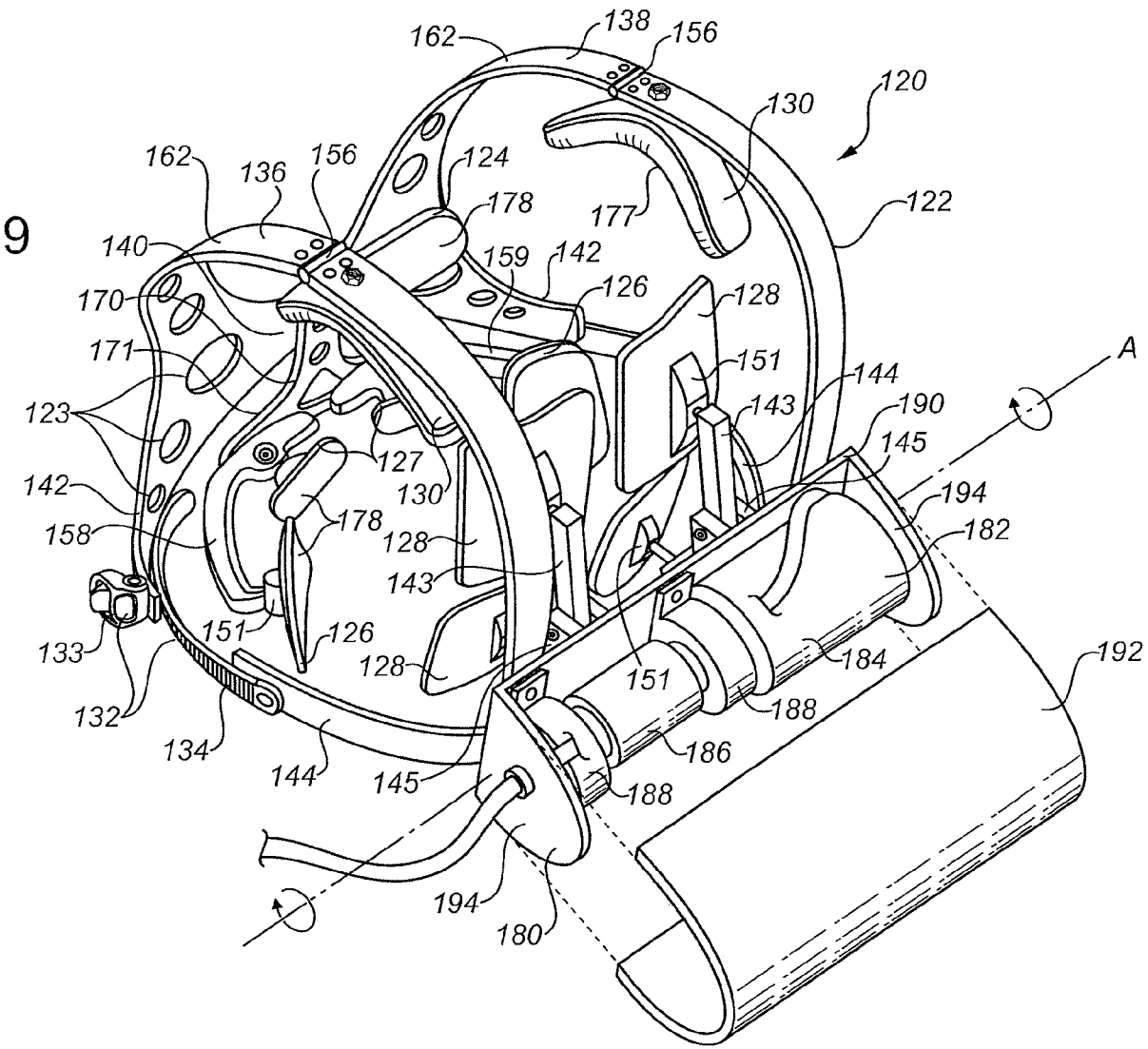
FIG. 9 is a partially exploded rear perspective view of the embodiment of FIG. 8, showing the vibrator housing cover removed to show the motor and off-set weight.
Figure 10:
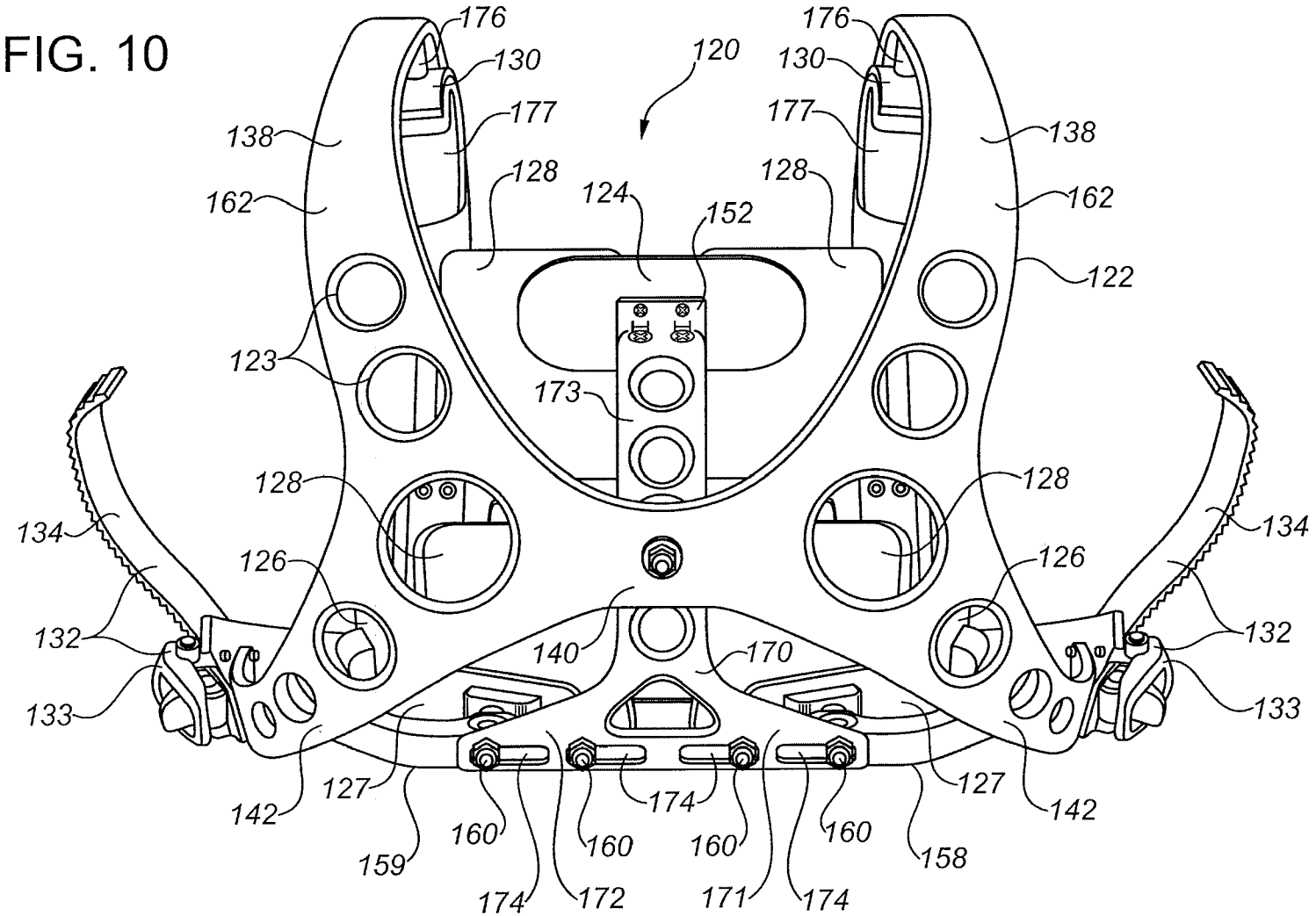
FIG. 10 is a front view of the embodiment of FIG. 8, showing details of the multiple adjustable front pads, the front pad support bar, and the arcuate support bars.
Figure 11:
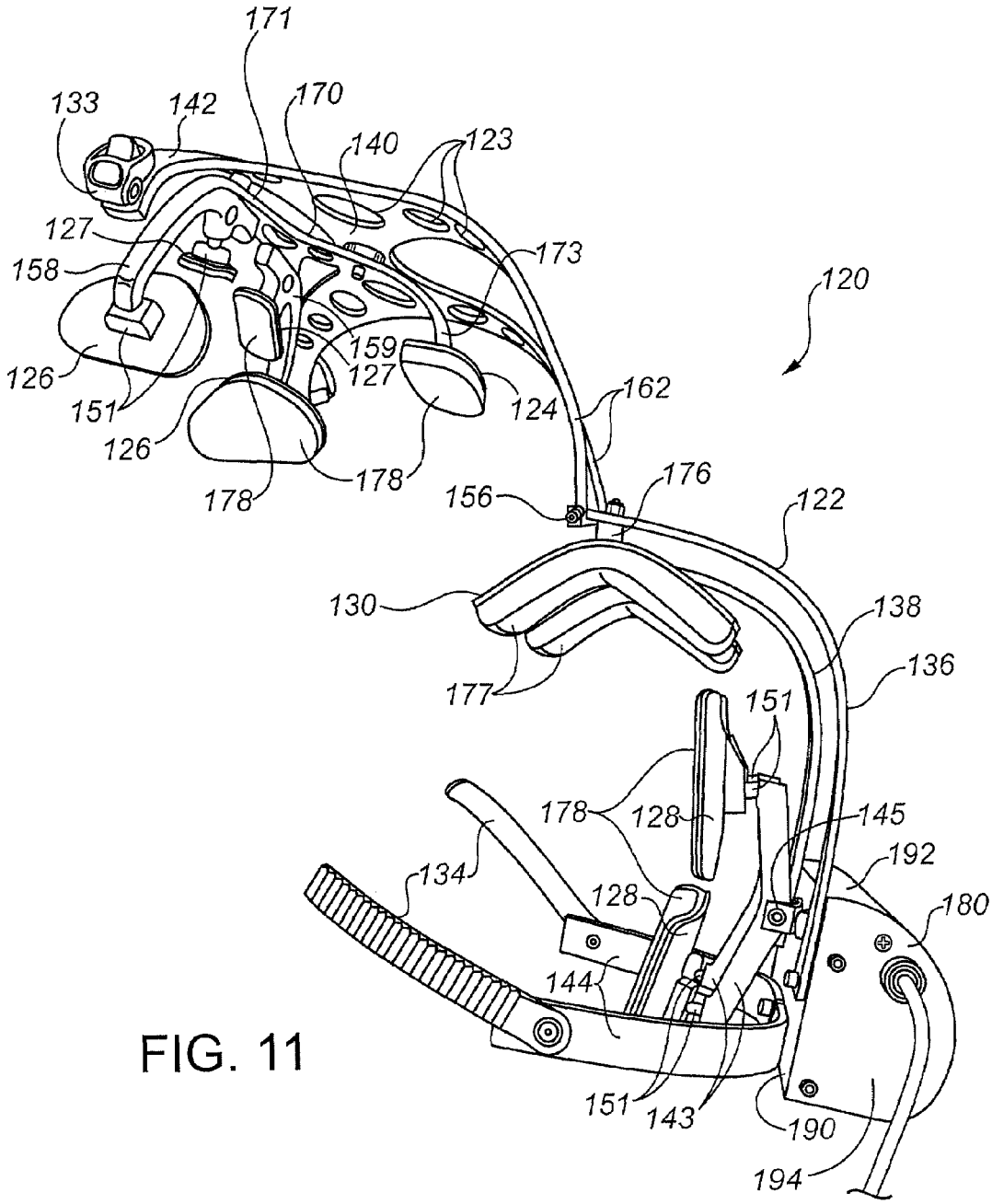
FIG. 11 is a side perspective view of the embodiment of FIG. 8, with the frame opened to allow a user to enter the frame, showing details of the multiple adjustable front and back pads, the rocker arms, and pad ball and socket and hinge connections.

To connect the back pads 128 for adjustability, in the specific embodiment shown in FIGS. 9, 11, a pair of vertical rocker arms 143 attach to the vibrator housing 180 by pivots 145 proximate to their midpoint, and position two pairs of back pads 128 over the back of the user on either side of the spine. The two pairs of back pads 128 connect to the rocker arms 143, one back pad connecting to each end of each rocker arm 143 by ball and socket connections 151 to allow adjustment of back pad 128 orientation to facilitate contact on the user's back on either side of the spine. The pivots 145 allow each rocker arm 143 to rotate around a lateral to medial axis to facilitate back pad 128 to chest contact.

As shown in FIG. 11, the shoulder pads 130 are curved shaped to fit over the shoulders of the user and include shoulder pad supports 176. The shoulder pads 130 are designed to transfer the weight of the invention to the shoulders of the user when the user is sitting or standing upright. The shoulder pads 130 are padded with soft shoulder pad cushions 177 to increase the comfort of the user. In the preferred embodiment, a deformable pad cover 178 is attached to each of the upper front pad 124, the side lower front pads 126, the lower front pads 127, and back pads 128, in which the pad covers are a layer of deformable material such as neoprene that covers the surface of the pad which contacts the users. When the vibrating device 120 is clamped to the user's chest, the pad cover deforms and moulds to the shape of the user for comfort, to facilitate pad to chest contact, and to enhance vibration transmission.

The vibrator 182 is best shown in FIG. 9. The vibrator 182 is contained in a vibrator housing 180. The vibrator 182 generates and imparts vibrations sufficient to transfer through the rigid frame 122 and the pads 124, 126, 127, 128 to the user's chest to assist in loosening of obstructions in the lungs or air way of the user. Vibrators 182 may involve motions generated by mechanical, electromagnetic, pneumatic, and hydralic mechanisms which rotate or oscillate vibrator components. In the preferred embodiment of this invention, the vibrator 182 includes a motor 184 which rotates an off-set weight 186 to cause vibrations. The rotating off-set weight (or rotating imbalance) 186 is mounted for rotation by two off-set weight bearings 188 attached to the vibrator housing 180. The motor 184 may typically be a 12 V DC or 120 V AC motor and is mounted to the vibrator housing 180. As is best illustrated in FIG. 9, the vibrator housing 180 includes a housing back bracket 190, two end plates 194, and a removable housing cover 192 allowing access to the vibrator for repair (FIG. 9 shows detached to view the motor 184 and off-set weight 186). The vibrator housing 180 connects to the frame 122 by the housing back bracket 190, which attaches to the left and right arms 136, 138, preferably at the back of the frame 122. In this embodiment, the off-set weight includes a rigidly mounted off-set weight shaft 187 (not shown), positioned through a hole in the off-set weight such that the shaft protrudes as stub shafts 189 (FIG. 12) on either side of the weight 186. The stub shafts 189 are supported by the bearings 188 and the off-set weight shaft 187 is connected to the motor 184 for direct rotation of the off-set weight 186. The motor 184 and the bearings 188 are connected to the back bracket 190 of the vibrator housing 180.

Figure 12:
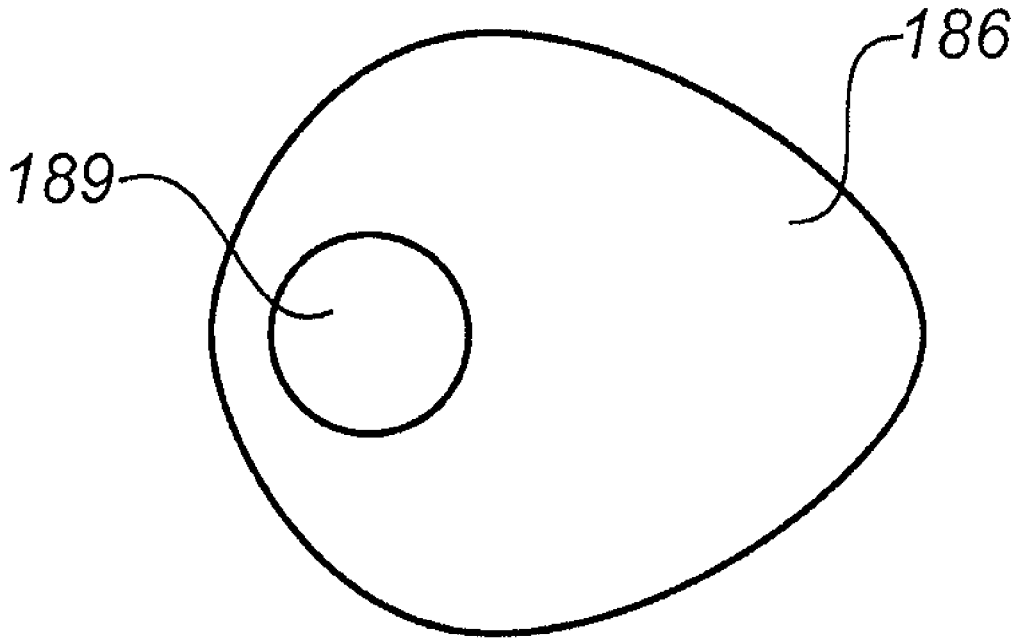
FIG. 12 is an end view of the off-set weight and shaft of the embodiment of FIG. 8, showing the preferred off-set weight shape, and the shaft position.

The amplitude of the vibrations generated by rotating the off-set weight 186 increases with the mass and off-set (the distance from the center of gravity to the center of rotation) of the rotating weight. The off-set weight of this specific embodiment of the invention is shown in FIGS. 9, 12. One example of an off-set weight 186 found to be effective was formed from a composite of a steel cylinder (3.8 cm in diameter, and 6.5 cm in length) with an off-center 1.3 cm sized hole drilled parallel to the long axis of the cylinder, located with the center of the hole 1 cm from the center of the steel cylinder, and by adding an additional mass of solder or other weight to the surface of the cylinder furthest from the offset hole. This resulting off-set weight had an approximately egg-shaped cross section of approximately 4.5 cm by 3.8 cm, as best shown in FIG. 12. This off-set weight 186 was rigidly connected to a 11.5 cm long, 1.3 cm diameter cylindrical steel off-set weight shaft 187. This off-set weight 186 had a total weight of 650 grams, including an off-set weight shaft 187 weighing 150 grams. Alternatives to this off-set weight or rotating imbalance will be evident to those skilled in the art, for instance with differing size, composition, weight, and off-set.

During operation, the motor 184 rotates the off-set weight 186 at a rate which transfers vibrations to the rigid frame 122 such that the vibration frequency is effective at loosening obstructions in the lungs or airways of the user. As discovered specifically during CF patient usage, preferred frequencies are greater than 10 Hz, more preferably at 11 to 20 Hz, and most preferably in a range of 13 to 16 Hz. Without limiting the scope of this invention, it is believed that these vibration frequency ranges are sufficient to stimulate the lung CBF to that normally observed in persons with unimpaired mucus clearance. The mass and degree of off-set of the off-set weight 186 are sufficient to generate vibrations with an amplitude which effectively transfers the vibrations through the rigid frame 122 and pads 124, 126, 127, 128 to the user's chest to assist in loosening of obstructions in the lungs and air way. When operating the vibrating device 120 with CF patients, it has been experimentally determined that vibration amplitudes of about 0.1 to 2 mm effectively transfer vibrations of the above frequency through the rigid frame 122 and pads 124, 126, 127, 128 to the user's chest. Preferably, the off-set weight 186 is mounted to rotate around an axis parallel to the medial to lateral axis of the user's chest, as is illustrated in FIG. 9 by the lateral to medial axis A. The chest vibrating device 120 can include a controller 198 (not shown) such as a dial to allow the user to vary the rate of rotation of the off-set weight, as will be apparent to those of ordinary skill in the art, to assist in loosening obstructions within the lungs or air way of the user.

Through testing of the vibrating device 120 with CF patients, it was discovered that when users may breath freely and deeply, without the device significantly impairing their lung vital capacity. Additionally, when wearing the device of the present invention, the user may continue to vibrate their chest while coughing to remove smaller lung and air way obstructions. To remove larger obstructions, the user only needs to temporarily stop the device's vibrations, then cough without ever having to remove the device form the chest.

With reference to FIGS. 8-11, the operation of the chest vibrating device 120 will be described as follows. The user lifts the front half 162 of the left and right arms 136, 138 upward along the hinges 156 to enter the rigid frame 122. Then, the user slips into the rigid frame 122, rests the shoulder pads 130 on the user's shoulders, and closes the front half 162 of the left and right arms 136, 138 along the hinges 156. The rocker arms 143 rotate to place the back pads 128 against the user's back on either side of the spine to overlie the scapulae and ribs of the user, and the back pads 128 rotate on ball and socket connections 151 to contact the user's back, preferably over the upper and lower lobes of the lungs. The left and right arcuate support bars 158, 159 are adjusted in a lateral to medial direction, and position the side lower front pads 126 and the lower front pads 127 over the lower side and front of the rib cage near the diaphragm, respectively, of the user's chest near a lower lobe of the lungs. The side lower front pads 126 and the lower front pads 127 rotate on ball and socket connections 151 to contact the front and sides, respectively, of the user's chest, preferably near a lower lobe of the lungs. The upper front pad 124 rotates to contact the pad against the user's chest over the sternum, preferably over the manubrium or upper gladiolus. Finally, the user uses the clamping units 132 to clamp and secure the rigid frame 122 about the user, such that the upper front pad 124, the side lower front pads 126, the lower front pads 127, and back pads 128 are securely clamped, or pressured, against the user's chest. The chest vibrating device 120 can then be activated to create vibrations. The motor 184 rotates the off-set weight 186, generating vibrations which are transferred from the vibrator 182 through the rigid frame 122 to the front pads 124, 126, 127 and back pads 128. These vibrations are transferred to the chest and lungs of the user via the pad to chest contact, and assist in removing obstructions from the lungs and air way of the user. The user may then control the frequency of vibrations by varying the rate of rotation of the off-set weight 186 via the controller 198, for a frequency which proves individually effective. As necessary, the user may start and stop the vibrator 182 to allow coughing to clear obstructions in the lungs and air way of the user without removing the vibrating device 120.

This invention is further exemplified by the following non-limiting examples:

EXAMPLE 1

Use of the Vibrating Device With a 24 Year Old Male Cystic Fibrosis Subject

The vibrating device embodied in FIGS. 8-11 was used to demonstrate the efficacy of this device in assisting clearing of the lungs and air ways of mucus in a cystic fibrosis subject. The subject was a 24 year old male, height 176.5 cm, and weight 76.2 kg.

The motor used to power the vibrator was a 120 V rotary motor, with a maximum speed of 2500 rotations per minute. The motor rotated an off-set weight fashioned from steel and solder. The weight was constructed with a cylinder of steel 3.8 cm in diameter, and 6.5 cm in length, with an off-center 1.3 cm sized hole drilled parallel to the long axis of the cylinder, located with the center of the hole 1 cm from the center of the steel cylinder. An additional mass of solder was added to the curved surface of the cylinder furthest from the offset hole, as described below. The weight was mounted and welded on a 11.5 cm long, 1.3 cm diameter cylindrical steel shaft, and was connected to the rotary motor.

The appropriate weight mass and off-set center of mass was determined experimentally by the subject. Layers of solder was incrementally added to the cylinder to shift the center of mass increasingly further from the position of the shaft through the steel cylinder. After each layer of solder was added, the subject tested the vibrating device for efficacy. Increasing amounts of solder initially led to improvements in device efficacy, however once efficacy began to decrease, solder was removed to restore the rotating mass to the optimal mass and off-set center of gravity.

The resulting weight found to be most efficient was 6.5 cm long and had an approximately egg-shaped cross section of approximately 4.5 cm by 3.8 cm. The off-set weight and shaft had a total weight of 650 grams, while the shaft itself weighed 150 grams.

The subject experimentally determined the preferred speed of rotation for the rotating mass. While wearing the vibrating device, the subject varied the motor's speed of rotation, noting the efficacy at various speeds. The subject observed that optimal lung and air way clearance occurred at 55% of the maximum motor rotation, but that the vibrating device produced significant lung clearing effects when rotating between 40% to 70% of the maximum motor rotation. High efficiency lung and air way clearance was observed by the user when the motor operated at 50-60% of the maximum motor rotation.

Using the optimized rotating mass, and the preferred speed of rotation, measurements were conducted of the subject while wearing and operating the vibrating device. The vibration amplitude and frequency was measured at nine points on the vibrating device, while the subject wore and operated the vibrating device but otherwise remained motionless. The subject avoided sneezing, coughing, or other activities which would move the chest. The resulting observations are compiled in Table 1, below:

TABLE 1

Observed vibration characteristics at selected positions on the vibrating device frame

| Location | Vibration Frequency (Hz) | Vibration Amplitude (mm) | Vibration Acceleration (g) |
|---|---|---|---|
| Left Bottom Back Pad | 14.75 | 0.54 | 0.47 |
| Right Bottom Back Pad | 15.33 | 0.15 | 0.14 |
| Top Left Back Pad | 14.25 | 0.7 | 0.57 |
| Top Right Back Pad | 15.5 | 0.2 | 0.2 |
| Front Left Frame | 14.25 | 0.8 | 0.66 |
| Left Side Lower Front Pad | 14.75 | 0.41 | 0.36 |
| Right Side Lower Front Pad | 15.08 | 0.71 | 0.65 |
| Upper Front Pad | 14.75 | 0.8 | 0.7 |
| Top Left Frame | 14.42 | 1.59 | 1.32 |

The data in Table 1 allowed determination of the average rigid frame vibration frequency (14.8 Hz) observed when operating the vibrating device at the optimal motor rotation rate, and the operating rigid frame vibration amplitude (0.1-2 mm). Using the optimal rigid frame frequency and the range of motor rotation speeds over which the user observed significant and high efficiency lung clearing effects, the frequency range of effective rigid frame vibration and preferred rigid frame vibrations was determined to be about 11 to 20 Hz, and 13-16 Hz, respectively.

When healthy and engaging in chest vibration therapy for preventative control of CF pathologies, the subject had used the vibrating device once or twice daily for 20 minute sessions, and reported the device was efficient in mobilizing mucus from his lungs. The subject also reported that while wearing and using the vibrating device, he was able to breath fully and deeply up to the user's vital capacity. When wearing the vibrating device, the subject reported being able to continue chest vibrations while coughing to remove certain smaller lung and air way obstructions. To remove larger obstructions, the subject remained within the vibrating device, but stopped the motor, coughed, then resumed vibration treatment as desired. This treatment replaced any daily CPT therapy delivered by a caregiver or other means. The subject increased the frequency and duration of these treatments as required to address infections and congestion beyond that normally experienced by an otherwise healthy CF patient.

EXAMPLE 2

Use of the Vibrating Device With a 20 Year Old Female Cystic Fibrosis Subject The vibrating device described in Example 1 was used to demonstrate the efficacy of this device in assisting clearing of the lungs and air ways of mucus in a cystic fibrosis subject. The subject was a 20 year old female, height 173 cm, and weight 55.4 kg.

When healthy and engaging in chest vibration therapy for preventative control of CF pathologies, the subject had used the vibrating device once or twice daily for 20 minute sessions, and reported the device was efficient in mobilizing mucus from her lungs. This treatment replaced any daily CPT therapy delivered by a caregiver or other means. The subject increased the frequency and duration of these treatments as required to address infections and congestion beyond that normally experienced by an otherwise healthy CF patient.

All publications mentioned in this specification are indicative of the level of skill in the art of this invention. All publications are herein incorporated by reference to the same extent as if each publication was specifically and individually indicated to be incorporated by reference.

The terms and expressions in this specification are, unless otherwise specifically defined herein, used as terms of description and not of limitation. There is no intention, in using such terms and expressions, of excluding equivalents of the features illustrated and described, it being recognized that the scope of the invention is defined and limited only by the claims that follow.

I claim:

1. A vibrating device for assisting in loosening of obstructions in the lungs or air way of a human user, the vibrating device comprising:

(a) a rigid frame for positioning and clamping around the user's chest;

(b) a plurality of pads connected to, and extending radially inwardly from, the rigid frame to contact the chest from opposite sides of the chest when the frame is clamped around the user's chest wherein the plurality of pads include: one or more pairs of back pads positioned to contact the back of the user on either side of the spine; and a plurality of front pads including an upper front pad positioned to contact the front of the user over the sternum, and one or more pairs of lower front pads positioned to contact the user's chest near the lower lobes of the lungs; and wherein the device further comprises: shoulder pads connected to, and extending radially inwardly from, the rigid frame, and positioned to contact the user's shoulders to support the vibrating device when the user is sitting or standing upright, and wherein: the upper front pad is pivotally connected to the rigid frame for movement around a lateral to medial axis to facilitate chest contact; the one or more pairs of lower front pads are each connected to the rigid frame by a ball and socket connection to facilitate chest contact; and the one or more pairs of back pads are each connected to the frame by a ball and socket connection to facilitate chest contact; and (c) a vibrator connected to the rigid frame, the vibrator generating and imparting vibrations sufficient to transfer through the rigid frame and pads to the user's chest to assist loosening of obstructions in the lungs or air way of the user, wherein the vibrations transferred are sufficient to stimulate the user's lung cilia beat frequency to assist in loosening of obstructions in the lungs or air way.

2. The vibrating device of claim 1, wherein the vibrations imparted to the rigid frame have a frequency greater than about 10 Hz.

3. The vibrating device of claim 1, wherein the vibrations imparted to the rigid frame have a frequency in the range of about 11 to 20 Hz.

4. The vibrating device of claim 3 wherein the amplitude of the vibrations is in the range of about 0.1 to 2 mm.

5. The vibrating device of claim 4, wherein one or more of the plurality of pads are connected to the rigid frame in an adjustable manner to adjust their position to accommodate users of differing size and gender.

6. The vibrating device of claim 5, wherein the one or more of the adjustable pads may be adjusted in a lateral to medial direction to adjust position.

7. The vibrating device of claim 6, wherein the one or more of the adjustable pads are connected to the rigid frame through a pivoting or a ball and socket connection to adjust orientation.

8. The vibrating device of claim 6, wherein the vibrations are generated by a motor and an off-set weight rotated by the motor.

9. The vibrating device of claim 8, wherein the off-set weight rotates around an axis parallel to a medial to lateral axis of the user's chest.

10. The vibrating device of claim 8, wherein the mass and off-set of the weight are such that the vibrations have an amplitude to effect transfer of the vibrations through the rigid frame and pads to the chest to assist in loosening of obstructions in the lungs or air way.

11. The vibrating device of claim 1, wherein the vibrations imparted to the rigid frame have a frequency in the range of about 13 to 16 Hz.

12. The vibrating device of claim 1, wherein there are two pairs of back pads positioned to contact the back of the user on either side of the spine, and wherein the device further comprises a pair of vertical rocker arms for connecting the pairs of back pads to the rigid frame, the pair of rocker arms being connected to the frame to position the pairs of back pads against the user's chest on either side of the user's spine, each rocker arm being pivotally connected proximate its midpoint to the rigid frame for rotation around a lateral to medial axis to facilitate chest contact, and one of the pairs of back pads being connected to each end of the rocker arms through a ball and socket connection.

13. The vibrating device of claim 12, which further comprises: a front pad support bar which is generally inverse T-shaped and which is connected to the rigid frame to position the plurality of front pads over the user's chest, the upper front pad being pivotally connected at the top of the support bar and positioned to contact the front of the user over the sternum; a pair of generally arcuate support bars, one being mounted generally horizontally to a left portion of the front pad support bar, and the other being mounted generally horizontally to a right portion of the front pad support bar, each of the arcuate support bars being connected, through a ball and socket connection, to a lower front pad positioned to contact the front of the user's chest near a lower lobe of the lungs, and to a lower front pad positioned to contact the side of the user's chest near a lower lobe of the lungs, and wherein each of the arcuate support bars is connected to the front pad support bar through a sliding slot connection for adjusting the arcuate support bars in a lateral to medial direction to position the lower front pads over users of differing size and gender.

* * * * *